US008890443B2

(12) United States Patent
Kang et al.

(10) Patent No.: US 8,890,443 B2
(45) Date of Patent: Nov. 18, 2014

(54) BACKLIGHT UNIT AND METHOD FOR CONTROLLING LED

(75) Inventors: Jeong-il Kang, Yongin-si (KR); Ju-taek Lee, Suwon-si (KR); Gil-yong Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 156 days.

(21) Appl. No.: 13/398,921

(22) Filed: Feb. 17, 2012

(65) Prior Publication Data

US 2013/0033198 A1 Feb. 7, 2013

(30) Foreign Application Priority Data

Aug. 4, 2011 (KR) ..... 10-2011-0077872

(51) Int. Cl.
*H05B 37/02* (2006.01)
*G09G 3/34* (2006.01)
*H05B 33/08* (2006.01)

(52) U.S. Cl.
CPC ..... *G09G 3/3406* (2013.01); *G09G 2330/045* (2013.01); *H05B 33/089* (2013.01); *G09G 2320/041* (2013.01)
USPC ..... 315/309; 315/294; 315/297

(58) Field of Classification Search
USPC ..... 315/291, 294, 297, 306, 307, 308, 309
See application file for complete search history.

(56) References Cited

U.S. PATENT DOCUMENTS

| | | | | |
|---|---|---|---|---|
| 6,617,808 | B2 * | 9/2003 | Ito et al. | 315/291 |
| 7,825,599 | B2 * | 11/2010 | Yagi et al. | 315/79 |
| 7,834,828 | B2 | 11/2010 | Arakawa et al. | |
| 2005/0099142 | A1 * | 5/2005 | Cottongim et al. | 315/309 |
| 2007/0132709 | A1 * | 6/2007 | Kawaguchi | 345/102 |
| 2007/0195025 | A1 | 8/2007 | Korcharz et al. | |
| 2010/0033113 | A1 | 2/2010 | Maruyama | |
| 2011/0291578 | A1 * | 12/2011 | Philippbar et al. | 315/224 |
| 2012/0081015 | A1 * | 4/2012 | Shimomura et al. | 315/188 |
| 2012/0256548 | A1 * | 10/2012 | Collins et al. | 315/151 |

OTHER PUBLICATIONS

Communication dated Aug. 24, 2012 issued by the European Patent Office in counterpart European Application No. 12161858.1.

* cited by examiner

*Primary Examiner* — Tung X Le
(74) *Attorney, Agent, or Firm* — Sughrue Mion, PLLC

(57) ABSTRACT

A backlight unit is provided, which includes a light-emitting diode LED, an LED driving unit which drives the LED, a control unit which measures a temperature of the LED driving unit, and, if the temperature exceeds a preset threshold temperature, interrupts an operation of the LED driving unit, and a threshold temperature adjustment unit which changes the preset threshold temperature based on a limit temperature of a circuit element included in the LED driving unit.

12 Claims, 7 Drawing Sheets

BACKLIGHT UNIT AND METHOD FOR CONTROLLING LED

This application claims priority from Korean Patent Application No. 10-2011-0077872, filed on Aug. 4, 2011, in the Korean Intellectual Property Office, the disclosure of which is incorporated herein by reference in its entirety.

BACKGROUND

1. Field

The present disclosure relates to a backlight unit and a method for controlling a light-emitting diode (LED), and more particularly to a backlight unit and a method for controlling an LED, which can prevent overheating through sensing of an internal temperature of an LED driving circuit.

2. Description of the Related Art

A shutter glass type three-dimensional (3D) LED backlight display alternately displays a left-eye image and a right-eye image on a screen. A shutter glass alternately transmits/intercepts a left-eye image and a right-eye image in synchronization with an image that is alternately displayed to realize a 3D image.

In this case, in order to minimize crosstalk of the left-eye image and the right-eye image, a backlight is driven with current having a smaller duty (i.e., duty cycle) in synchronization with the image. If the duty is reduced as described above, luminance of a display is decreased. Accordingly, in order to compensate for the decrease of luminance, a 3D current having a peak value that is several times higher than a peak value of a two-dimensional (2D) normal current is generated.

FIG. 1 is a diagram illustrating a waveform of a 2D current. Referring to FIG. 1, the duty of the 2D current may be maximally extended up to 100% while it performs pulse width modulation (PWM) dimming of the backlight in a predetermined period.

FIG. 2 is a diagram illustrating a waveform of a 3D current. Referring to FIG. 2, the peak value of the 3D current may be greatly increased in comparison to the peak value of the 2D normal current.

By contrast, the maximum duty of an on time range of the 3D current illustrated in FIG. 2 is limited in comparison to the maximum duty of an on time range of the 2D current illustrated in FIG. 1.

FIG. 3 is a diagram explaining the occurrence of fuming due to 3D current overload in a 3D mode. Referring to FIG. 3, the occurrence of fuming in respective elements of an LED driving circuit due to 3D current overload will be examined as follows.

During a 3D normal operation, a 3D overload occurs due to an error of a driving circuit or other systems at time $t_s$. The temperature of an integrated circuit (IC) is increased from the overload occurrence time $t_s$. At the same time, the temperature (L temperature) of an inductor that is an element of the LED driving circuit is increased.

If the L temperature reaches a limit temperature at time $t_f$, the inductor starts fuming. At this time, since the threshold temperature Tjmax of the integrated circuit is much higher than the limit temperature of the inductor, an overheating prevention function in the integrated circuit does not operate, and thus a control unit is unable to control the operation of the LED driving circuit.

Accordingly, overcurrent flows through the LED driving circuit and thus internal elements of the LED driving circuit or a backlight unit itself may be damaged and may lead to the occurrence of a serious accident, such as a fire.

In the related art, Over-Temperature Protection (OTP) has been used to prevent the overheating. However, since the OTP is the last means for preventing damage of an internal chip due to the overheating, the corresponding threshold temperature is set to a maximally high temperature Tjmax.

Due to this, there is a great difference between the threshold temperature of the integrated circuit and the limit temperature of the LED driving circuit, and thus even at a temperature where the LED driving circuit is overheated due to overload, the integrated circuit cannot perform a normal operation to cause OTP not to operate. Due to this, there has been a problem in that fuming or fire first occurs in respective elements, for example, inductors or transistors, included in the LED driving circuit.

SUMMARY

The present disclosure has been made to address at least the above problems and/or disadvantages and to provide at least the advantages described below. Accordingly, an aspect of the present disclosure provides a backlight unit and a method for controlling an LED, which can prevent overheating of an LED driving circuit through detection of an internal temperature of the LED driving circuit.

An exemplary embodiment of the present disclosure provides a backlight unit which includes an LED; an LED driving unit which drives the LED; a control unit which measures a temperature of the LED driving unit and if the temperature exceeds a preset threshold temperature, interrupts an operation of the LED driving unit; and a threshold temperature adjustment unit which changes the threshold temperature on the basis of limit temperatures of circuit elements included in the LED driving unit.

The LED driving unit may include a DC-DC converter which converts an input voltage into an LED driving voltage according to an operation of a transistor that is controlled by the control unit and provides the LED driving voltage to the LED.

The control unit may include a resistor unit which has a resistance value that changes according to the temperature of the LED driving unit; and a comparator unit which compares a voltage value of the resistor unit with a reference voltage, and if the voltage value exceeds the reference voltage, outputs a control signal for turning off the transistor.

The threshold temperature adjustment unit may include a voltmeter which provides a voltage that corresponds to a minimum temperature among limit temperatures of the circuit elements to the comparator unit as the reference voltage.

The threshold temperature adjustment unit may include a plurality of resistors connected in series; a plurality of switches arranged between connection nodes between the plurality of resistors and a reference voltage input terminal of the comparator unit; and an adjustment unit which adjusts the reference voltage through control of on/off operations of the switches according to a user selection.

Another exemplary embodiment of the present disclosure provides a method for driving an LED which includes converting an input voltage into an LED driving voltage and driving the LED; and measuring a temperature of a driving circuit that drives the LED, and, if the temperature exceeds a threshold temperature, interrupting an operation of the driving circuit; wherein the threshold temperature is a changeable temperature that is changed on the basis of limit temperatures of circuit elements included in the driving circuit.

The interrupting step may include detecting a voltage value of a resistor unit which has a resistance value that changes according to a temperature of the driving circuit; and comparing the voltage value of the resistor with a reference voltage, and if the voltage value exceeds the reference voltage, turning off a transistor that drives the driving circuit.

The reference voltage may be a voltage which corresponds to a minimum temperature among the limit temperatures of the circuit elements, and may be provided from a voltmeter connected to a comparator that compares the voltage value of the resistor unit with the reference voltage.

According to the various embodiments of the present disclosure, overheating of the whole elements of the LED driving circuit can be prevented through measurement of an internal temperature of the LED driving circuit

BRIEF DESCRIPTION OF THE DRAWINGS

The above and other aspects, features and advantages of the present disclosure will be more apparent from the following detailed description when taken in conjunction with the accompanying drawings, in which.

DETAILED DESCRIPTION

Hereinafter, exemplary embodiments of the present disclosure are described in detail with reference to the accompanying drawings. However, the present disclosure is not restricted or limited to such exemplary embodiments. For reference, in explaining the present disclosure, well-known functions or constructions will not be described in detail so as to avoid obscuring the description with unnecessary detail.

Figure 1:
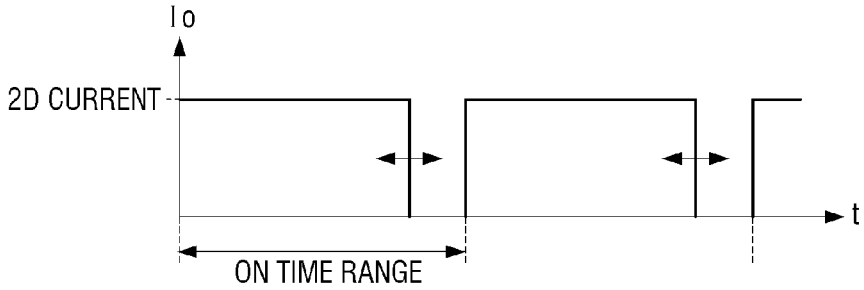
FIG. 1 is a diagram illustrating a waveform of a 2D current.
Figure 2:
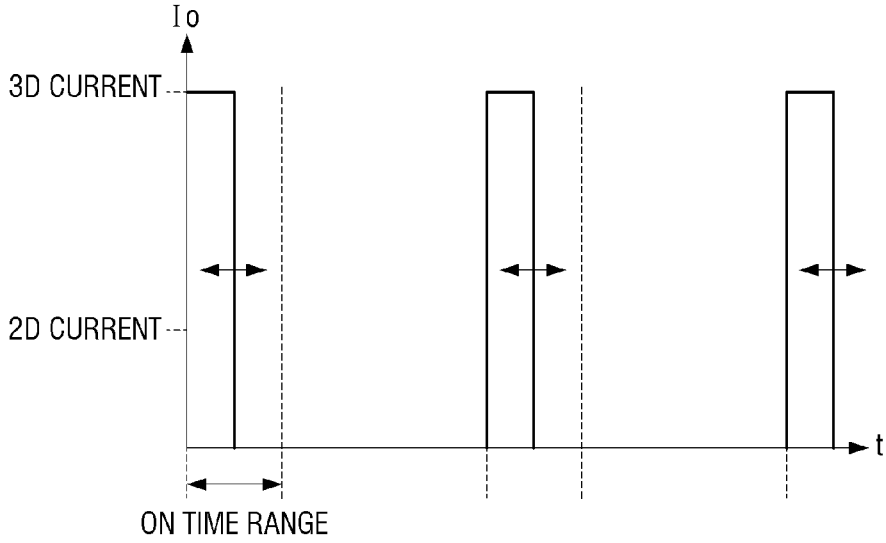
FIG. 2 is a diagram illustrating a waveform of a 3D current.
Figure 3:
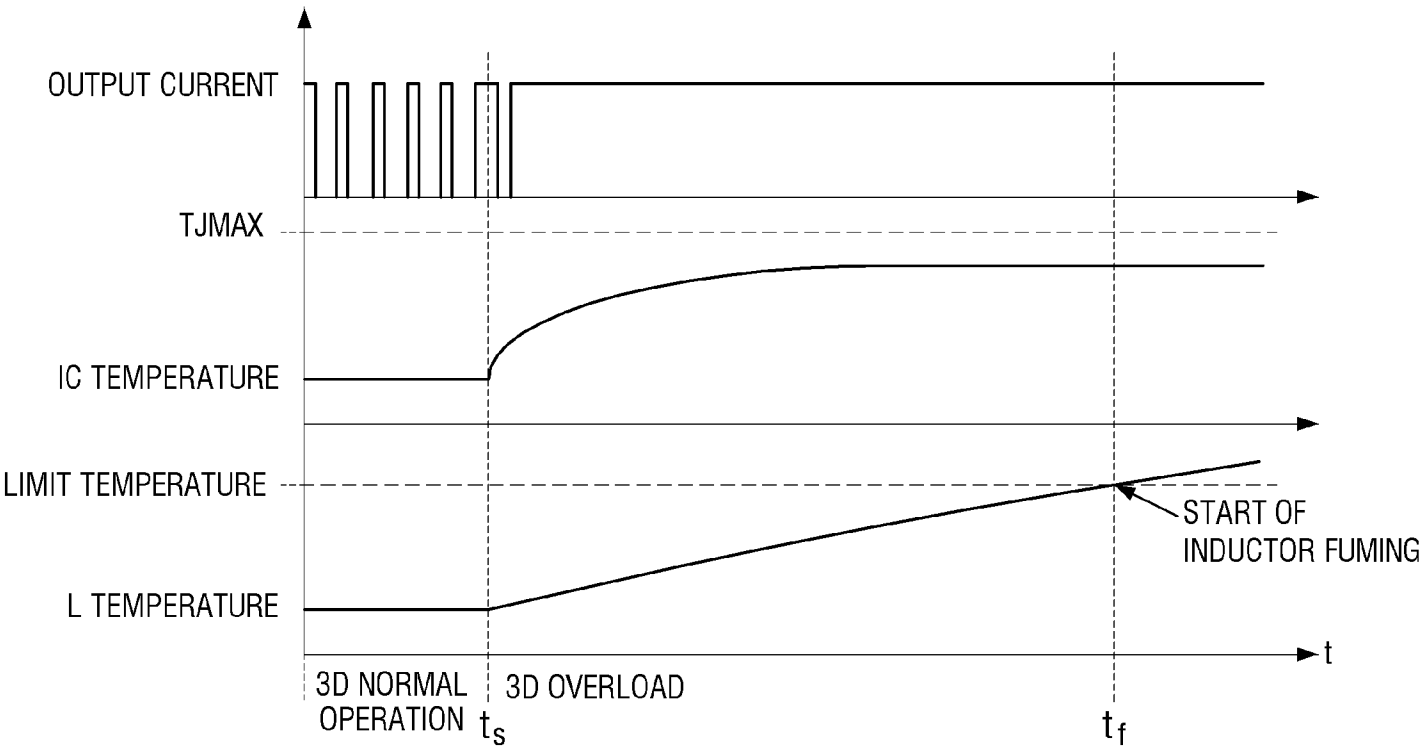
FIG. 3 is a diagram explaining the occurrence of fuming due to 3D current overload in a 3D mode.
Figure 4:
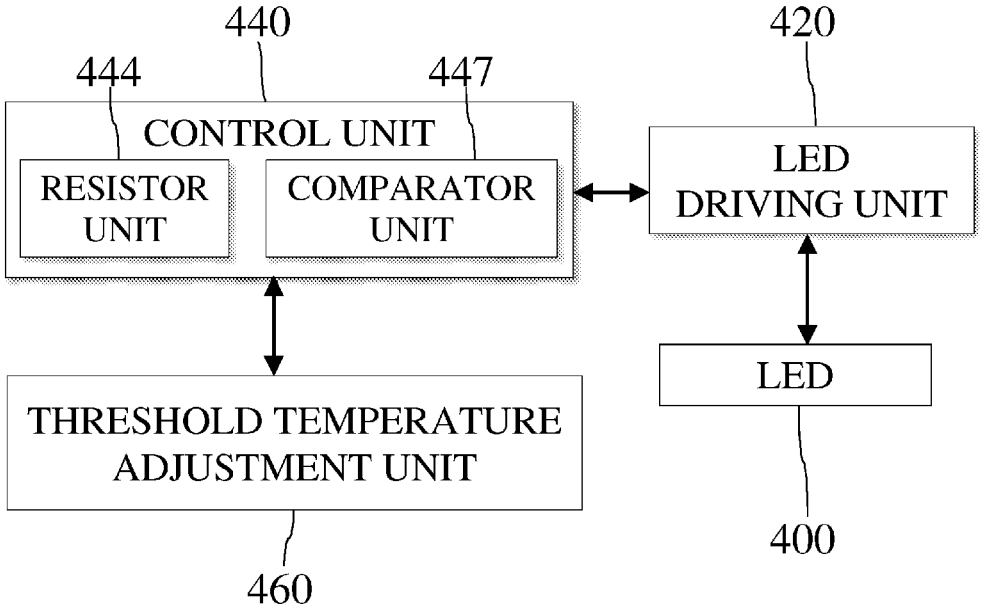
FIG. 4 is a block diagram illustrating the configuration of a backlight unit according to an exemplary embodiment of the present disclosure.

FIG. 4 is a block diagram illustrating the configuration of a backlight unit according to an exemplary embodiment of the present disclosure.

Referring to FIG. 4, a backlight unit according to an exemplary embodiment of the present disclosure includes an LED 400, an LED driving unit 420, a control unit 440, and a threshold temperature adjustment unit 460.

The LED 400 receives a driving signal and power from the LED driving unit 420, and emits light according to the driving signal.

The LED driving unit 420 is controlled by the control unit 440 to supply the driving signal and the power to the LED 400.

Specifically, the LED driving unit 420 is controlled by the control unit 440. That is, the control unit 440 provides an on or off control signal for controlling a switch that performs a switch operation in the LED driving unit 420. A DC-DC converter converts an input voltage into a power for driving the LED according to switching operation of the switch, and provides the power to the LED 400.

The control unit 440 functions to interrupt the operation of the LED driving unit 420 if an internal temperature of the LED driving circuit 420 exceeds a preset threshold temperature.

Specifically, the control unit 440 includes a resistor unit 444 having a resistance value that is changed according to the temperature of the LED driving unit 420, and a comparator unit 447 comparing a voltage value of the resistor unit 444 with a reference voltage, and if the voltage value exceeds the reference voltage, outputting a control signal for turning off a transistor of the LED driving circuit 420 (e.g., a transistor of the DC-to-DC converter).

Here, the resistor unit 444 may be implemented by a P-N junction diode of which the resistance value changes according to the change of temperature. Further, the comparator unit 447 may be implemented by, but is not limited to, an operational amplifier (Op-Amp) that can compare two input voltages.

The comparator unit 447 compares the voltage value of the resistor unit 444 with the reference voltage value, and if the voltage value of the resistor unit 444 exceeds the reference value, the comparator unit 447 outputs the control signal for turning off the transistor.

If the transistor is turned off, the internal current of the LED driving circuit and the LED is reduced. If the current that flows through the LED 400 is reduced, the overheating of the LED driving circuit 420 can be prevented.

The threshold temperature adjustment unit 460 may change the threshold temperature of the control unit 440 on the basis of limit temperatures of the circuit elements included in the LED driving unit 420.

More specifically, as described above, the preset threshold temperature of the control unit 440 is much higher than that of the circuit elements included in the LED driving unit 420. If the control unit 440 is operable at the preset threshold temperature, the control unit 440 does not operate even at a temperature that exceeds the limit temperature of the circuit elements of the LED driving unit 420, and thus the circuit elements of the LED driving unit 420 may be damaged due to the overheating.

The threshold temperature adjustment unit 460 adjusts the preset threshold temperature of the control unit 440 to the limit temperatures of the elements included in the LED driving unit 420. As described above, the preset threshold temperature is much higher than the limit temperatures of the respective elements included in the LED driving unit 420. If the threshold temperature of the control unit 440 is adjusted to the limit temperature, the control unit 440 can start the operation at a temperature that is lower than the preset threshold value, and thus the elements included in the LED driving unit 420 can be protected at the lower temperature.

Figure 5:
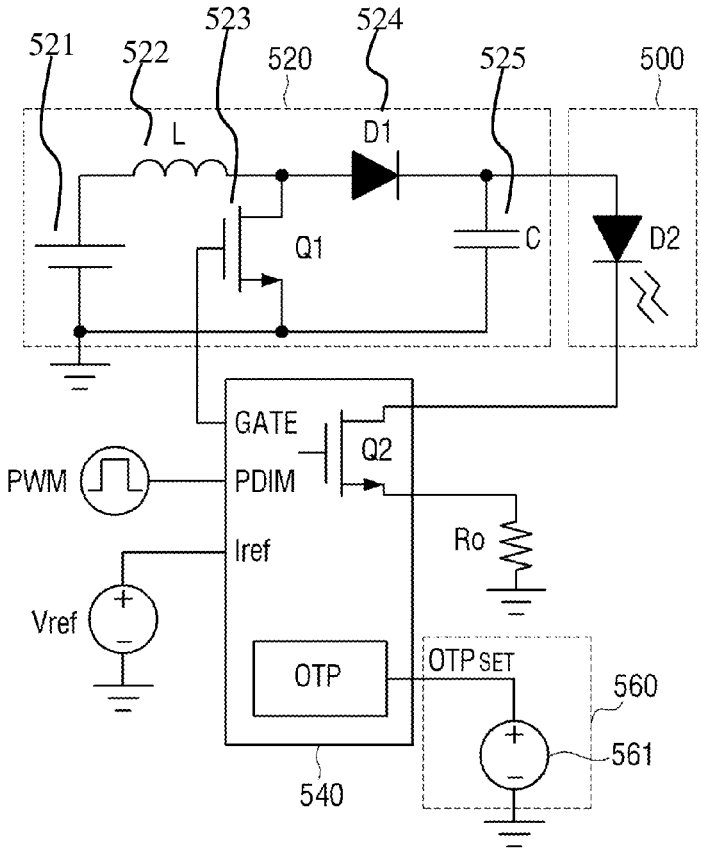
FIG. 5 is a diagram illustrating a more detailed configuration of a backlight unit according to an exemplary embodiment of the present disclosure.

FIG. 5 is a diagram illustrating a more detailed configuration of a backlight unit according to an exemplary embodiment of the present disclosure.

The backlight unit includes an LED 500, an LED driving unit 520, a control unit 540, and a threshold temperature adjustment unit 560.

The LED 500 receives a driving signal and power from the LED driving unit 520. If the LED 500 is driven, the temperature of the LED driving unit 520 is increased.

The LED driving unit 520 may include a DC-DC converter, including a diode D1 and a switch element. The DC-DC converter performs conversion of DC power and supplies the converted power to the LED D2.

Further, the switch element may be implemented by a first transistor Q1 that is driven based on the ground to realize an LED backlight driving waveform, and thus it is possible to turn on and off the current at high speed with convenience in operation.

The control unit 540 controls the operation of the LED D2 through control of the DC-DC converter through the switch element Q1.

The control unit 540 detects the temperature of the LED driving unit 520 (e.g., a temperature at diode D1). The control unit 540 may include a temperature sensor installed therein or may detect the temperature of the LED driving unit 620 using a temperature sensor installed outside the control unit 540.

Further, the control unit 540 may include an Over-Temperature Protection (OTP) unit and a second transistor Q2.

Here, the OTP unit performs over-temperature protection for protecting the integrated circuit from being damaged when the internal temperature of the integrated circuit exceeds the threshold temperature and thus the integrated circuit is overheated.

The OTP unit operates if an overload is applied to a gate terminal due to the damage of the first transistor Q1 or if an overcurrent flows to the second transistor Q2 due to the damage of the LED D2 or the like.

The second transistor Q2 is an element that performs PWM dimming by turning on/off the LED current. Since the second transistor Q2 requires capacitance that is in proportion to the current output to the LED D2, unlike the first transistor Q1 that requires capacitance that is in proportion to the power output to the LED D2, the second transistor Q2 has only a slight limitation in design according to its applications, and thus can be easily integrated in the inside of the control unit 540 to realize the integrated circuit as illustrated in FIG. 5.

The current that flows through the LED D2 passes through the second transistor Q2 and flows to ground through an output resistor Ro. The current, which flows through the LED D2 and is sensed by the output resistor Ro, is compared with the reference value Iref inside the control unit 540. The duty of the first transistor Q1 is varied according to an output of a gate that is generated according to the result of the comparison, so that the current that is sensed by the output resistor Ro is controlled to follow the reference value Iref.

That is, by varying the reference value Iref, it becomes possible to control the peak value of the current that is output to the LED D2.

A PDIM terminal of the control unit 540 is a terminal that receives the PWM dimming signal. In accordance with a signal input to the PDIM terminal, the second transistor Q2 is turned on/off to perform the PWM dimming.

Although a boost type 3D LED driving circuit is representatively illustrated in FIG. 5, the LED driving circuit is not limited thereto. Other types of circuits such as buck or buck-boost type circuits may be used instead.

Further, although the second transistor Q2 of FIG. 5 is merely turned on/off according to the PDIM signal as described above, it can be implemented as an element that can directly control the current flowing to the LED through fine control of the gate voltage. In the latter case, the first transistor Q1 is not adjusted to control the current of the LED D2, but may be adjusted to control a special voltage or the voltage at both ends of the second transistor Q2.

The threshold temperature adjustment unit 560 compares the detected temperature of the LED driving unit 520 with the limit temperatures of the respective circuit elements 521-525 included in the LED driving unit 520. As non-limiting examples, respective circuit elements 521-525 of the LED driving unit 520 may include an inductor L 522, the first transistor Q1 523, the diode D1 524, and a capacitor C 525.

If it is determined that the detected temperature exceeds the limit temperatures of the respective circuit elements 521-525 as the result of the comparison, the threshold temperature adjustment unit 560 changes the preset threshold temperature of the control unit 540 to the limit temperature.

Referring to FIG. 5, the threshold temperature adjustment unit 560 may be implemented by a voltmeter 561.

In this case, the voltmeter 561 provides the voltage that corresponds to the minimum temperature among the limit temperatures of the respective circuit elements 521-525 included in the LED driving unit 520 as the reference voltage.

On the other hand, the threshold temperature adjustment unit 560 may be implemented by a current meter in addition to the voltmeter. Further, the threshold temperature adjustment unit 560 may be implemented by a means which changes a current value and a voltage value from the outside by a user.

The threshold temperature adjustment unit 560 inputs the voltage that corresponds to the minimum temperature among the limit temperatures of the respective circuit elements 521-525 included in the LED driving unit 520 to the control unit 540 as the reference voltage (OTP set).

As the reference voltage of the control unit 540 is changed to the voltage value that corresponds to the limit temperature, the preset threshold temperature of the control unit 540 is changed to a new threshold temperature that corresponds to the different reference voltage. The new threshold temperature becomes the minimum temperature among the limit temperatures of the respective circuit elements 521-525 included in the LED driving unit 520.

The control unit 540 compares the newly set threshold temperature with the internal temperature of the LED driving unit 520, and if the internal temperature of the LED driving unit 520 exceeds the newly set threshold temperature, it controls the operation of the LED driving unit 520 to prevent the respective circuit elements 521-525 of the LED driving unit 520 from being overheated.

That is, if the internal temperature of the LED driving unit 520 exceeds the minimum temperature among the limit temperatures of the respective circuit elements 521-525 included in the LED driving unit 520, the control unit 540 starts its operation to control the operation of the LED driving unit 520, and thus the respective circuit elements 521-525 included in the LED driving unit 520 can be prevented from being overheated.

The threshold temperature adjustment unit 560 may be configured to include an adjustment unit that adjusts reference voltage through and on and off control of a plurality of resistors connected in series, a plurality of switches arranged between the connection nodes of the resistors and the reference voltage input terminal of the comparator unit, or a plurality of switches which operate according to the user selection.

Figure 6:
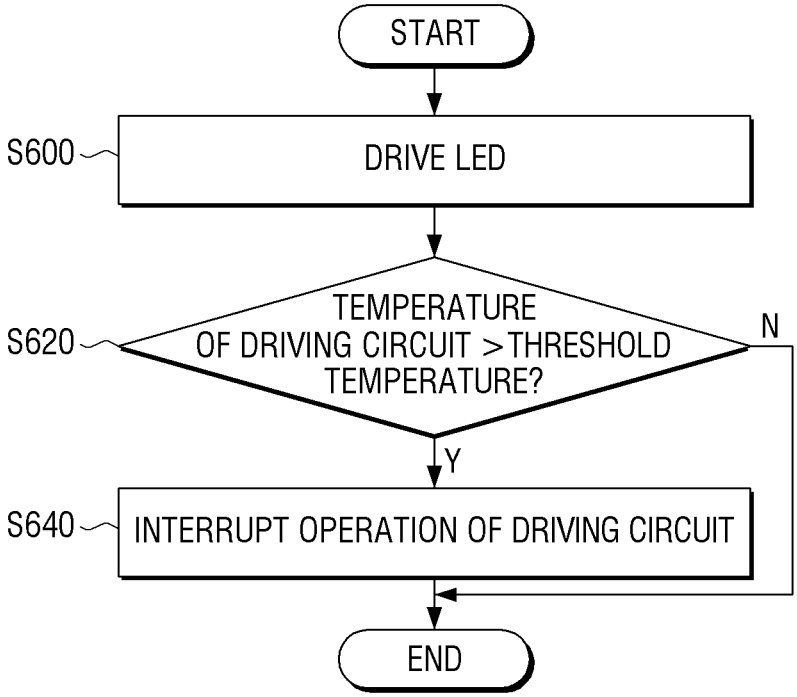
FIG. 6 is a diagram illustrating a method for controlling an LED according to another exemplary embodiment of the present disclosure.

FIG. 6 is a diagram illustrating a method for controlling an LED according to another embodiment of the present disclosure.

Referring to FIG. 6, the method for controlling an LED according to another exemplary embodiment of the present disclosure may include driving an LED (S600), comparing the temperature of the LED driving circuit with a preset threshold temperature (S620), and interrupting an operation of the driving circuit (S640).

The operation of driving the LED (S600) converts the input power into an LED driving power to operate the LED.

The operation of comparing the internal temperature of the LED driving circuit with the threshold temperature (S620) measures the internal temperature of the LED driving circuit that is generated through the operation of the LED, and determines whether the measured internal temperature exceeds the threshold temperature.

The operation of interrupting the operation of the driving circuit (S640) includes interrupting the operation of the LED driving circuit if the measured internal temperature exceeds the threshold temperature ("Y" in S620).

In this case, the threshold temperature is a temperature that is changeable on the basis of the respective limit temperatures of the circuit elements included in the LED driving circuit. Accordingly, the threshold temperature may be the set according to the circuit element that has the lowest limit temperature.

Figure 7:
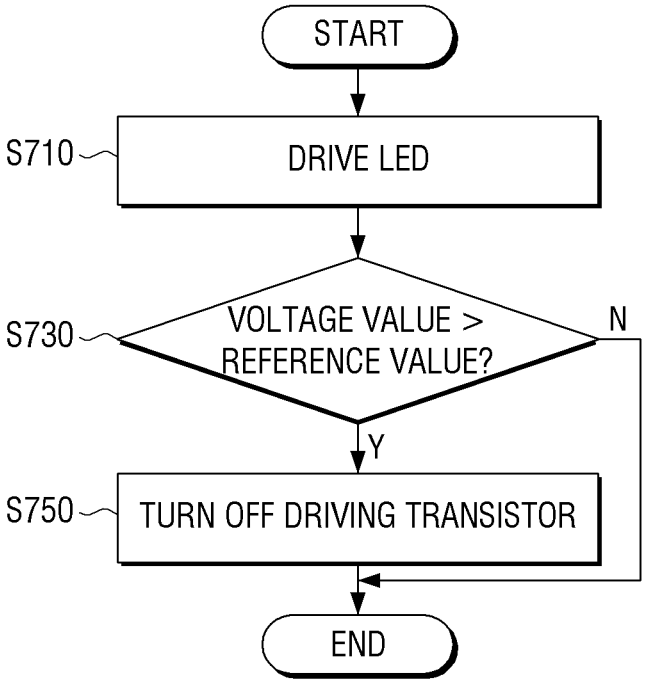
FIG. 7 is a diagram illustrating in more detail a method for controlling an LED according to another exemplary embodiment of the present disclosure.

FIG. 7 is a diagram illustrating in detail the method for controlling an LED according to another exemplary embodiment of the present disclosure.

Referring to FIG. 7, the method for controlling an LED includes driving an LED (S710), comparing the voltage value with the reference value (S730), and turning on and off a driving transistor (S750).

The operation of driving an LED (S710) applies the driving signal and the power to the LED to operate the LED.

The operation of comparing the voltage value with the reference voltage (S730) further performs detection of a voltage value of a resistor unit having a resistance value that changes according to the temperature of the LED driving circuit. The detected voltage value corresponds to the temperature of the inside of the LED driving circuit.

The detected voltage value is compared with the reference voltage value. This is equivalent to comparing of the internal temperature of the LED driving unit with the threshold temperature.

According to the result of the comparison, the operation of turning on and off the driving transistor (S750) turns off the transistor that drives the LED driving circuit if the voltage value exceeds the reference voltage value.

In this case, the reference voltage is a voltage that corresponds to the minimum temperature among the limit temperatures of the circuit elements, and is provided to be compared with the voltage value of the resistor unit.

If the voltage value of the resistor unit exceeds the reference voltage value, the driving transistor is turned off to decrease the current that flows to the LED. By decreasing the current that flows to the LED, the internal temperature of the LED driving circuit is decreased.

The internal temperature of the LED driving unit continues to be monitored after turning off the transistor, and if the internal temperature of the LED driving circuit falls to the predetermined temperature, the control unit turns on the driving transistor and thus the current that flows to the LED is increased.

If it is determined that the voltage value of the resistor unit exceeds the reference voltage ("Y" in S730), the control unit operates to interrupt the current that flows to the LED, and may increase the current that flows through the LED again after a predetermined time elapses.

Figure 8:
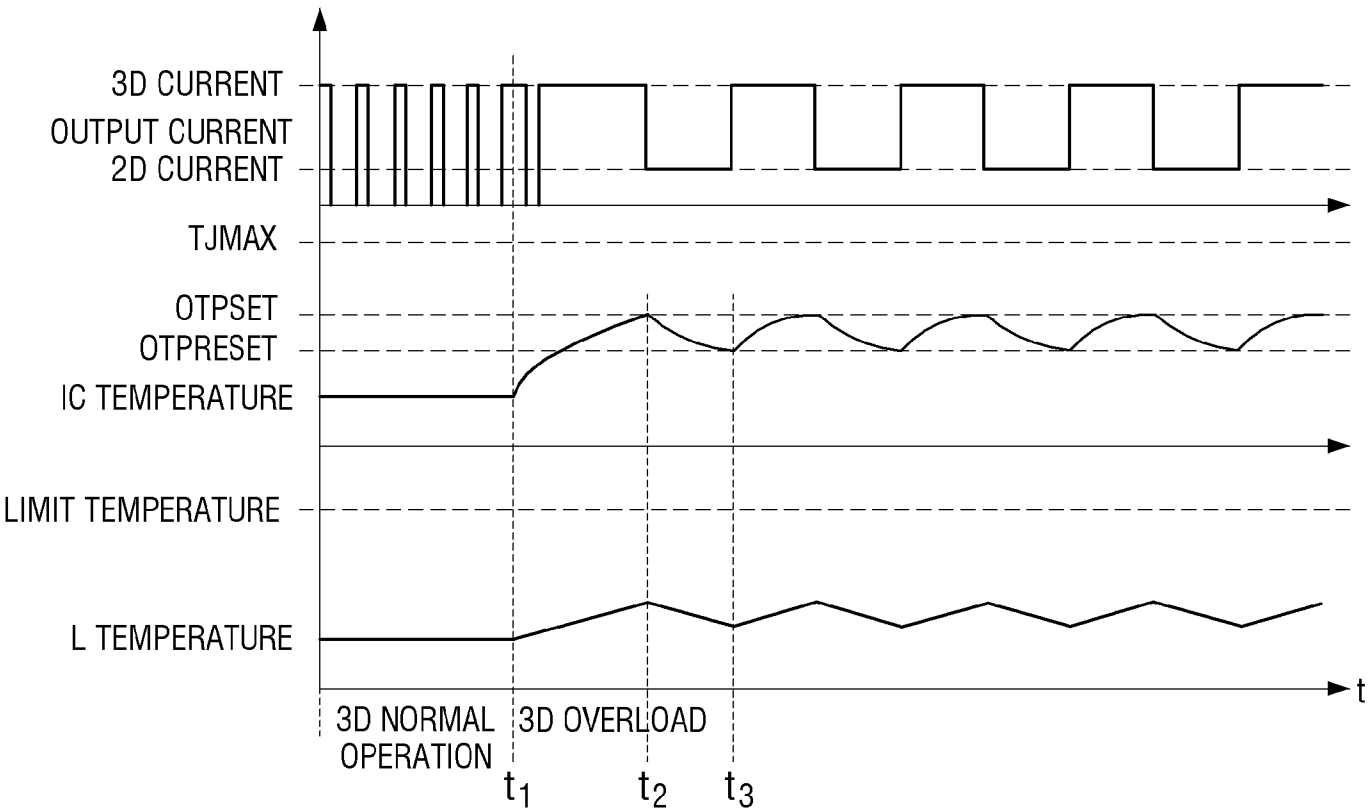
FIG. 8 is a diagram explaining the control of an LED temperature according to an exemplary embodiment of the present disclosure.

FIG. 8 is a diagram explaining the control of an LED temperature according to an exemplary embodiment of the present disclosure.

Referring to FIG. 8, the process of adjusting the LED through the method for controlling the LED according to an exemplary embodiment of the present disclosure will be described.

In FIG. 8, at an initial time, 3D current operates normally. At a time $t_1$ when the 3D current is overloaded, the temperature of the inductor (L temperature) starts to increase, and the temperature of the integrated circuit (IC temperature) also starts to increase.

Since the IC temperature does not reach the preset threshold temperature Tjmax of the integrated circuit, the control unit does not operate. If it is determined that the internal temperature of the LED driving unit is higher than the minimum limit temperatures of the respective elements, the threshold temperature adjustment unit sets the reference voltage that corresponds to the internal temperature as a new reference voltage of the control unit.

If the threshold temperature adjustment unit sets the new reference voltage in the control unit, the control unit operates at a time $t_2$ when the new reference voltage is set to control the operation of the LED driving unit, and thus the driving of the LED is stopped or the current that flows to the LED is decreased.

Accordingly, after the time $t_2$ when the new reference voltage is set, the temperature of the integrated circuit (IC temperature) is decreased. At the same time, the temperature of the inductor (L temperature) that is one of the elements of the LED driving unit is decreased. At this time, the operation of the LED driving unit may be controlled so that the IC temperature and the L temperature continue to be decreased. However, at the time $t_3$ when the temperature reaches the predetermined temperature, the control unit controls the operation of the LED driving unit again to drive the LED or to increase the current that flows to the LED.

If the current that flows to the LED is increased, the temperature of the LED driving unit is increased, and in accordance with the threshold temperature of the control unit, the control unit starts or stops the control operation.

According to various exemplary embodiments of the present disclosure, the present disclosure can be applied to a backlight unit and can be implemented by one modularized integrated circuit to be applied to various kinds of circuit overheating prevention devices.

While the present disclosure has been shown and described with reference to certain exemplary embodiments thereof, it will be understood by those skilled in the art that various changes in form and detail may be made therein without departing from the spirit and scope of the present disclosure, as defined by the appended claims

What is claimed is:

1. A backlight unit comprising:

a light-emitting diode (LED);

an LED driving unit which drives the LED;

a control unit configured to measure a temperature of the LED driving unit and, if the temperature exceeds a preset threshold temperature, interrupt an operation of the LED driving unit; and a threshold temperature adjustment unit configured to change the preset threshold temperature based on a limit temperature of a circuit element included in the LED driving unit.

2. The backlight unit as claimed in claim 1, wherein the LED driving unit comprises a DC-DC converter configured to convert an input voltage into an LED driving voltage according to an operation of a transistor that is controlled by the control unit and provide the LED driving voltage to the LED.

3. The backlight unit as claimed in claim 1, wherein the control unit comprises:

a resistor unit which has a resistance value configured to change according to the temperature of the LED driving unit; and a comparator unit configured to compare a voltage value of the resistor unit with a reference voltage, and, if the voltage value exceeds the reference voltage, outputs a control signal for turning off a transistor.

4. The backlight unit as claimed in claim 3, wherein the threshold temperature adjustment unit comprises a voltmeter configured to provide a voltage that corresponds to a minimum temperature among limit temperatures of circuit elements included in the LED driving unit to the comparator unit as the reference voltage.

5. The backlight unit as claimed in claim 3, wherein the threshold temperature adjustment unit comprises:

a plurality of resistors connected in series;

a plurality of switches arranged between connection nodes between the plurality of resistors and a reference voltage input terminal of the comparator unit; and an adjustment unit configured to adjust the reference voltage through control of an on operation and an off operation of the switches according to a user selection.

6. The backlight unit as claimed in claim 3, wherein, after the transistor is turned off, the comparator unit continues to compare the voltage value of the resistor unit with the reference voltage, and, if the voltage value of the resistor unit decreases to be equal to or less than the reference voltage, outputs another control signal for turning on the transistor.

7. The backlight unit as claimed in claim 1, wherein the control unit comprises a resistor unit which has a resistance value configured to change according to the temperature of the LED driving unit, and wherein the control unit is configured to interrupt an operation of the LED driving unit based on the resistance value of the resistor unit.

8. A method for driving a light-emitting diode (LED) comprising:

converting an input voltage into an LED driving voltage and driving the LED; and measuring a temperature of a driving circuit that drives the LED; and when the temperature exceeds a threshold temperature, interrupting an operation of the driving circuit;

wherein the threshold temperature is a changeable temperature that is changed based on a limit temperature of a circuit element included in the driving circuit.

9. The method for driving an LED as claimed in claim 8, wherein the interrupting step comprises:

detecting a voltage value of a resistor unit which has a resistance value that changes according to the temperature of the driving circuit;

comparing the voltage value of the resistor unit with a reference voltage; and when the voltage value exceeds the reference voltage, turning off a transistor that drives the driving circuit.

10. The method for driving an LED as claimed in claim 9, wherein the reference voltage is a voltage which corresponds to a minimum temperature among limit temperatures of circuit elements included in the LED driving unit, and is provided from a voltmeter connected to a comparator that compares the voltage value of the resistor unit with the reference voltage.

11. The method for driving an LED as claimed in claim 9, further comprising:

after the transistor is turned off, turning on the transistor, when the voltage value of the resistor unit decreases to be equal to or less than the reference voltage.

12. The method for driving an LED as claimed in claim 8, wherein the interrupting step comprises:

detecting a voltage value of a resistor unit which has a resistance value that changes according to the temperature of the driving circuit; and turning off a transistor that drives the driving circuit based on the detected voltage value.

* * * * *